US006939513B2

(12) United States Patent
Berray et al.

(10) Patent No.: US 6,939,513 B2
(45) Date of Patent: Sep. 6, 2005

(54) FLEXIBLE SEPTA CLOSURE PLUG MATS FOR WELL PLATE MOUNTED ARRAYS OF SAMPLE VIALS

(75) Inventors: James St. John Berray, Redding, CT (US); Michael Bruce Buxton, New Preston, CT (US)

(73) Assignee: Soltec, Inc., Bethel, CT (US)

( * ) Notice: Subject to any disclaimer, the term of this patent is extended or adjusted under 35 U.S.C. 154(b) by 162 days.

(21) Appl. No.: 10/211,159

(22) Filed: Aug. 2, 2002

(65) Prior Publication Data

US 2002/0187077 A1 Dec. 12, 2002

Related U.S. Application Data

(63) Continuation-in-part of application No. 09/496,371, filed on Feb. 2, 2000, now Pat. No. 6,455,005.

(51) Int. Cl.[7] ..... B65D 43/04; B01L 3/00

(52) U.S. Cl. ..... 422/99; 422/102; 215/355; 215/247; 220/255; 435/305.3

(58) Field of Search ..... 215/364, 247, 215/355, DIG. 3, 261; 220/801, 255–255.1; 604/416; 422/99, 102; 435/305.2, 305.3

(56) References Cited

U.S. PATENT DOCUMENTS 2,655,282 A * 10/1953 Dunbar
3,302,854 A * 2/1967 Midgley et al.
3,551,273 A * 12/1970 McKinney
3,552,591 A * 1/1971 Wimmer ..... 215/247
3,760,969 A * 9/1973 Shimamoto et al. ..... 215/247
4,248,355 A * 2/1981 Kolb et al. ..... 215/274
4,366,912 A * 1/1983 Matukura et al. ..... 215/247
4,441,621 A * 4/1984 Matukura et al. ..... 215/247
5,538,134 A * 7/1996 Pitesky
6,106,783 A * 8/2000 Gamble ..... 422/102
6,136,273 A * 10/2000 Seguin et al. ..... 422/99
6,202,878 B1 * 3/2001 Cook
6,455,005 B1 * 9/2002 Berray et al. ..... 422/99

FOREIGN PATENT DOCUMENTS

GB 2334954 A * 9/1999

OTHER PUBLICATIONS

Hawley's Condensed Chemical Dictionary (Lewis, Richard Sr., 13th ed., John Wiley & Sons, Inc., p. 997).*

* cited by examiner

*Primary Examiner*—Terry K. Cecil
(74) *Attorney, Agent, or Firm*—Milton Oliver, Esq.; Ware Fressola Van Der Sluys & Adolphson LLP

(57) ABSTRACT

A flexible elastomer closure plug mat presents a plurality of protruding hollow septa closure plugs depending from the mat's lower face. The mat and protruding closure plugs are preferably formed of silicone rubber, with a thick layer of polytetrafluoroethylene or TEFLON® durably bonded to the lower face of the mat and to the outer faces of all of the arrayed plurality of closure plugs. The arrayed plurality of closure plugs are dimensioned for telescoping insertion into the open tops of a corresponding plurality of sample vials held in a well plate, and for frictional engagement therein.

6 Claims, 4 Drawing Sheets

FLEXIBLE SEPTA CLOSURE PLUG MATS FOR WELL PLATE MOUNTED ARRAYS OF SAMPLE VIALS

This application is a continuation-in-part of co-pending U.S. patent application Ser. No. 09/496,371 filed Feb. 2, 2000 now U.S. Pat. No. 6,455,005 for which priority is claimed under 35 U.S.C. §120.

This invention relates to flexible closure plug mats presenting arrayed pluralities of septa closure plugs for convenient insertion in the open upper ends of corresponding arrayed pluralities of sample vials mounted in well plates for use in chromatography equipment. More particularly, this invention avoids contamination of liquid samples by employing an assembly of a flexible silicone elastomer body having anchored to its underside a relatively thick Teflon® layer presented to the sample vials' contents.

BACKGROUND OF THE INVENTION

Autosampling chromatography equipment marketed by Hewlett-Packard, Perkin-Elmer, Merck/Hitachi and other manufacturers accommodates standard sizes of well plates, such as the 96-vial well plate carrying twelve rows of eight vials each, illustrated in the FIGURES. The wells of these well plates are sized to receive thin-walled glass vials, 5 mm or 6 mm in diameter, for example, to be loaded by pipettes with liquid samples to be analyzed. Once loaded, closure plugs or septa are inserted and secured by crimped metal rims, by screw caps, or by elastomer friction. Closure plugs may be of polyethylene, natural rubber or silicone rubber. Inert outer coatings of polytetrafluoroethylene (PTFE or "TEFLON®") have been proposed, sprayed or dusted on the surface of such elastomer plugs to minimize contamination of liquid samples in vials, but such sprayed PTFE coatings can be scraped off or degraded during opening and closing operations, and their performance has been unreliable and unpredictable.

BRIEF SUMMARY OF THE INVENTION

It has now been discovered that a thick layer 21 of Teflon®, at least about 0.100 mm or 0.004 inches in thickness, durably bonded at 30 to the lower face of the elastomer septa closure plug mat 22, to be exposed to liquid samples and solvents loaded into the glass vials 23, forms a highly dependable closure system for the entire array of sample vials, minimizing or eliminating contamination of all samples.

A principal object of the invention is therefore to produce elastomer septa closure plug mats 22 for multiple arrays of sample vials 23 mounted in a well plate 24 in standard arrays, eliminating contamination of vial sample contents.

Another object of the invention is to provide such closure plug mats 22 of durably bonded dual layer construction, presenting a permanent inert surface facing the sample contents of the arrayed vials 23.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

THE DRAWINGS

For a fuller understanding of the nature and objects of the invention, reference should be made to the following detailed description taken in connection with the accompanying drawings, in which.

BEST MODE FOR CARRYING OUT THE INVENTION

Figure 5:
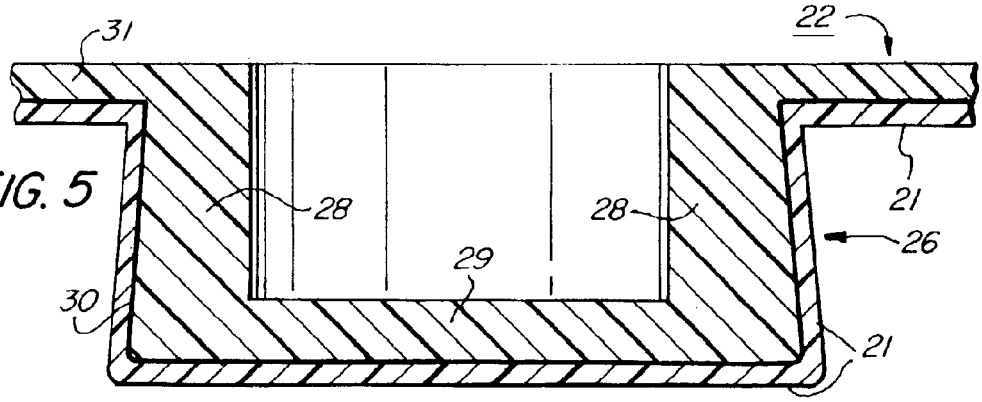
FIG. 5 is a greatly enlarged cross-sectional elevation view of a first embodiment of the flexible closure plug mat of the invention.
Figure 6:
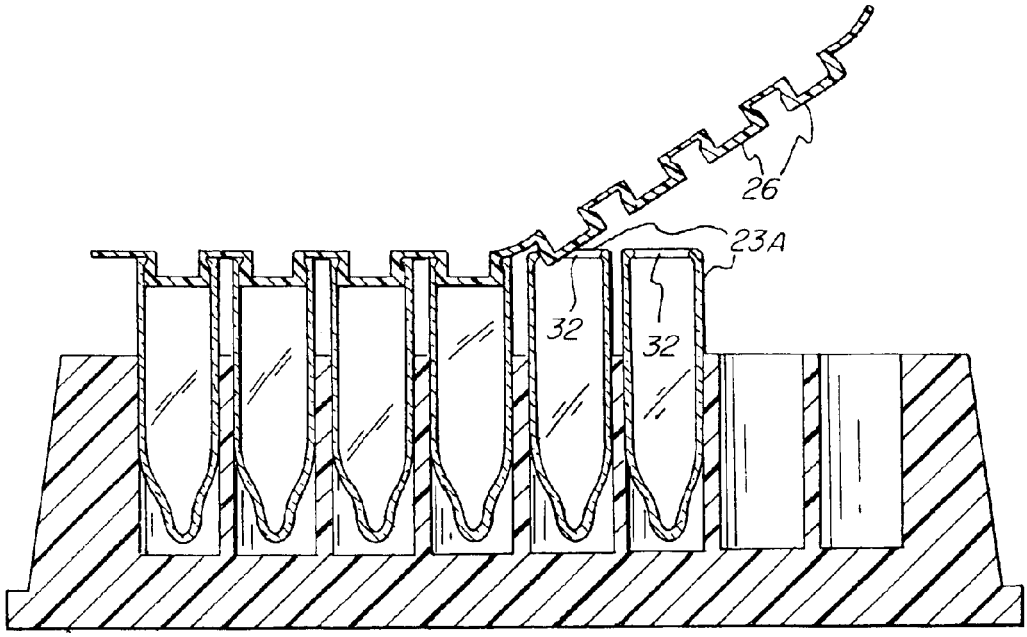
FIG. 6 is a view similar to FIG. 4, showing a second embodiment of the invention.
Figure 7:
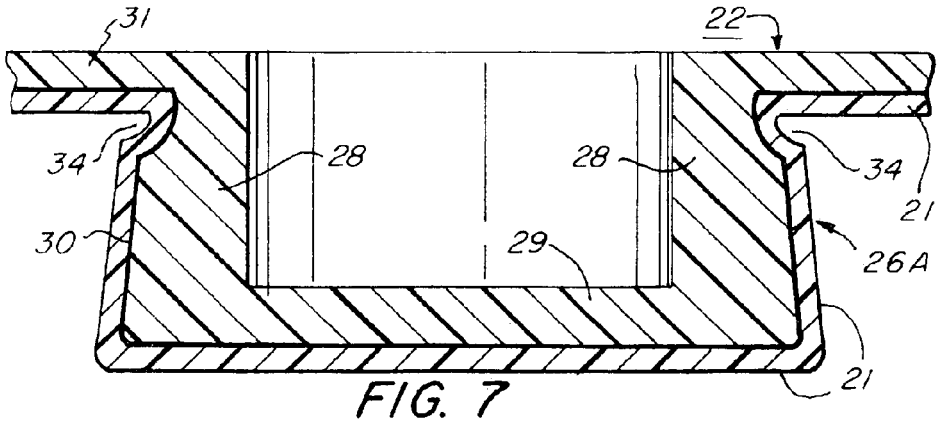
FIG. 7 is a view similar to FIG. 5 showing the second embodiment of the invention.
Figure 8:
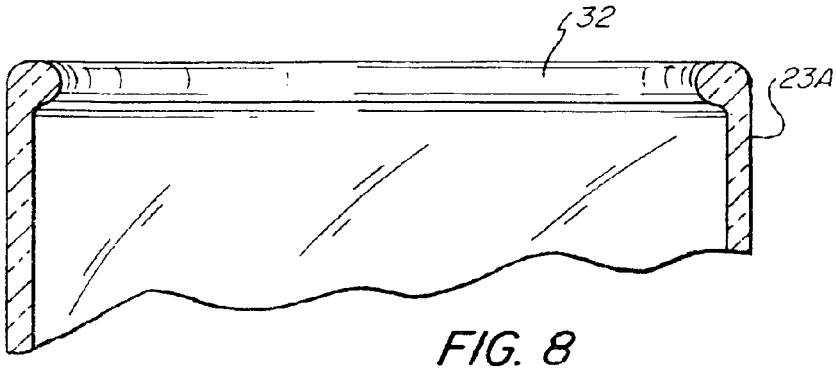
FIG. 8 is a greatly enlarged fragmentary cross-sectional view of the open top of a vial such as those shown in FIG. 6.
Figure 9:
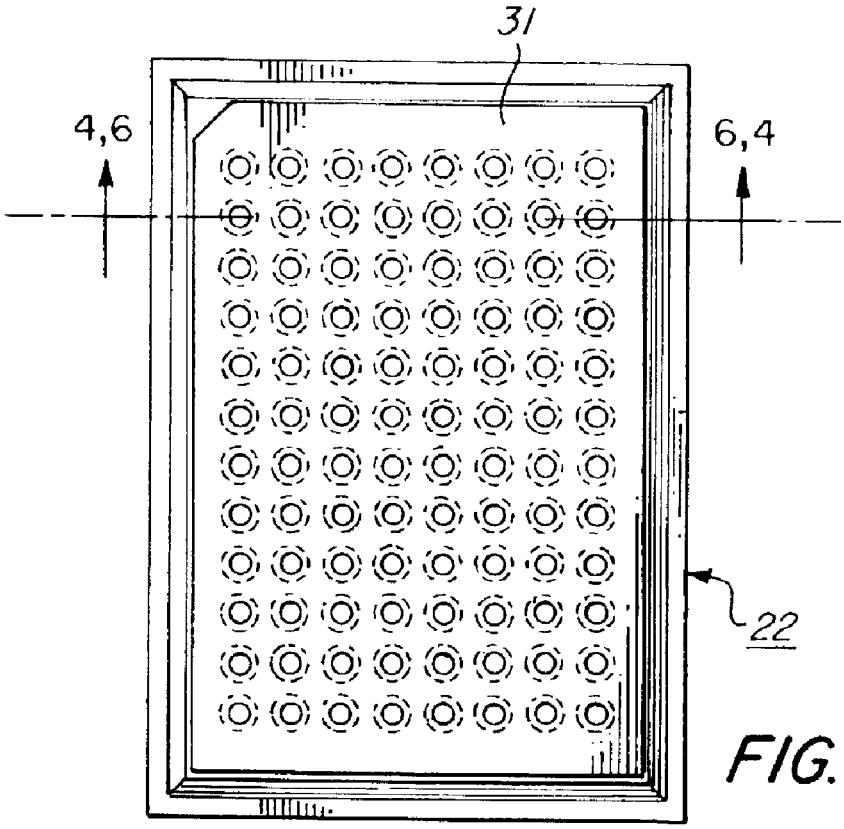
FIG. 9 is a reduced plan view of a flexible closure plug mat of the invention.
Figure 10:
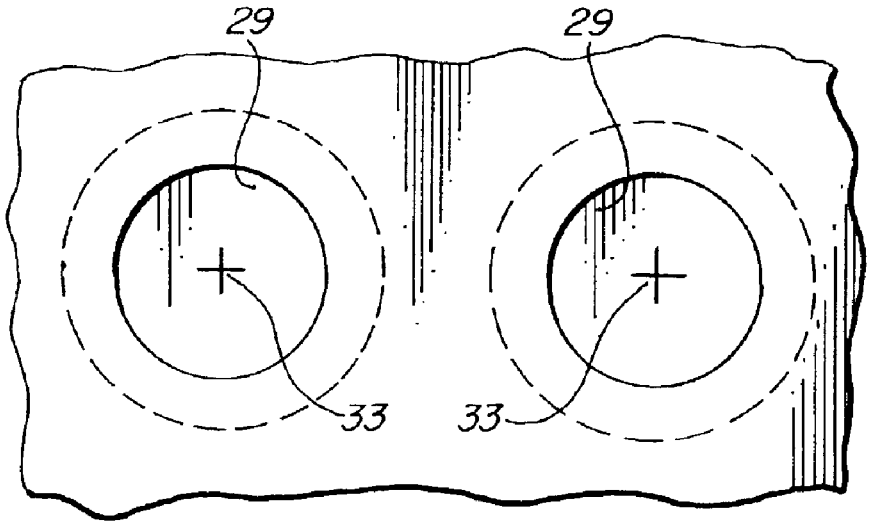
FIG. 10 is a fragmentary enlarged plan view of a portion of the mat shown in FIG. 9.

As best seen in FIGS. 5 and 7, each of the septa closure plugs 26 presented by the elastomer mats 22 of this invention, for insertion in the open tops of sample vials 23 held in arrayed pluralities of wells 27 in standard well plates 24, is a downwardly depending convex basket-shaped protuberance or plug 26 with gently reversely tapered sidewalls 28 spanned by a uniform floor 29. In one standard mat-well plate assembly, the center-to-center distance between adjacent vials is 9 mm, and the typical outside diameters of the vials may be 5, 6 or 7 mm, for example.

In the closure plugs of both FIGS. 5 and 7, the maximum distal outside diameter at the lower ends of the plugs 26 is 0.265 inches, or 6.731 mm, slightly greater than the internal diameter of the 7 mm vials. The floor 29 of the closure plug is 0.025 inches or 0.635 mm in thickness, while the slightly reversely tapered plug walls 28 are about 0.04875" inches or 1.238 mm thick at their thickest, at the distal or floor end, tapering down to 0.0415 inches or 1.121 mm at the proximal or mat end. The negative taper of the closure plugs' outer walls 28 is therefore a nominal 84°, and thus the reverse taper of the sidewalls falls between about 82 degrees and about 86 degrees from a transverse plane parallel to the flexible elastomer sheet's bottom face.

The closure plug mats 22 of this invention are preferably formed of an elastomer such as silicone rubber, molded as a flexible elastomer sheet between about 0.012 and 0.018 inches in thickness from which the closure plugs 26 depend, as shown in FIGS. 1, 2, 4, 5, 6 and 7, with the entire lower face of the closure plug mat being formed by a thick layer 21 of Teflon®, an inert elastomer, preferably from about 0.003" to about 0.007" in thickness, more preferably between about 0.004" and about 0.006" in thickness. A Teflon® layer 21 0.005" or 0.127 mm thick is suitable, and is durably bonded at 30 to the silicone mat body 31 by hot stamping between heated mold halves, to provide the sturdy cross-section illustrated in the FIGURES, by curing for about 10 minutes at between about 300° F. and about 350° F.

The term "inert elastomer" as applied to sample vial caps or plugs is believed to be well understood in the industry to mean inert to substances and fluids contained in sample vials to avoid contamination thereof. This is exemplified by the description of the "thin coating" or thin layer of PTFE described in column 2, lines 31 to 39 of the Chromacol Cook U.S. Pat. No. 6,202,878 B1 as having as its purpose "to prevent reaction between the plug and the contents of the vial." However, Cook's admittedly thin coating of PTFE, with no thickness specified, amounts to no more than a dusting, serving only as a mold release agent, but not as a barrier film, producing widespread dissatisfaction in the industry and a long-felt need for a truly effective inert barrier protecting the vials' contents.

Applicants' mat preferably has a complete, continuous, 0.0050-inch thick layer of PTFE Teflon on one side. This thick Teflon layer acts as a complete barrier film against any extractables contained in the mat layer of silicone rubber. It also acts as a barrier film against the passage of any escaping gaseous products contained in the sample being analyzed in the vial.

The Cook patent says the Cook mat has a PTFE layer on one side, but it is not a continuous layer, nor is it a layer of any measurable thickness. The Cook patent shows no such layer in its drawings; no reference numeral identifies any such layer, and no thickness is stated. On this Chromacol Cook product, the Teflon film is applied as a spray, prior to molding, and it essentially acts as a mold release agent but not as a barrier layer. Customers using this mat regularly complain of problems with siloxane poisoning, from the silicone rubber in the mat, when conducting an analysis of the sample in the vial.

Silicone rubber polymer is primarily composed of chains of dimethylpolysiloxane. During the rubber curing process most, if not all, of the long chains are hooked together and form the silicone rubber. However, a number of the short chains do not get linked and they migrate around in the rubber and volatilize off when the rubber is heated. It's these short chains that destroy the accuracy of any analysis of the materials in the vials, because they appear on the liquid chromatography and gas chromatography analysis curves as many different peaks, which significantly disguise, or hide, the real culprits that the chemists are looking for in the material they are analyzing.

In the septa closure plug 26A illustrated in FIG. 7, the mat is similarly mated to vials held in a standard 96-well plate 24, and the glass vials 23A held in the 96 wells are provided with an internal bead 32 extending inwardly from the interior of their open top rims. Each of the septa plugs 26A is provided with a recessed groove 34 encircling its minimum diameter upper end positioned to receive and embrace the internal top bead on one of the glass vials. This provides a positive lock between vials and septa plugs.

Figure 1:
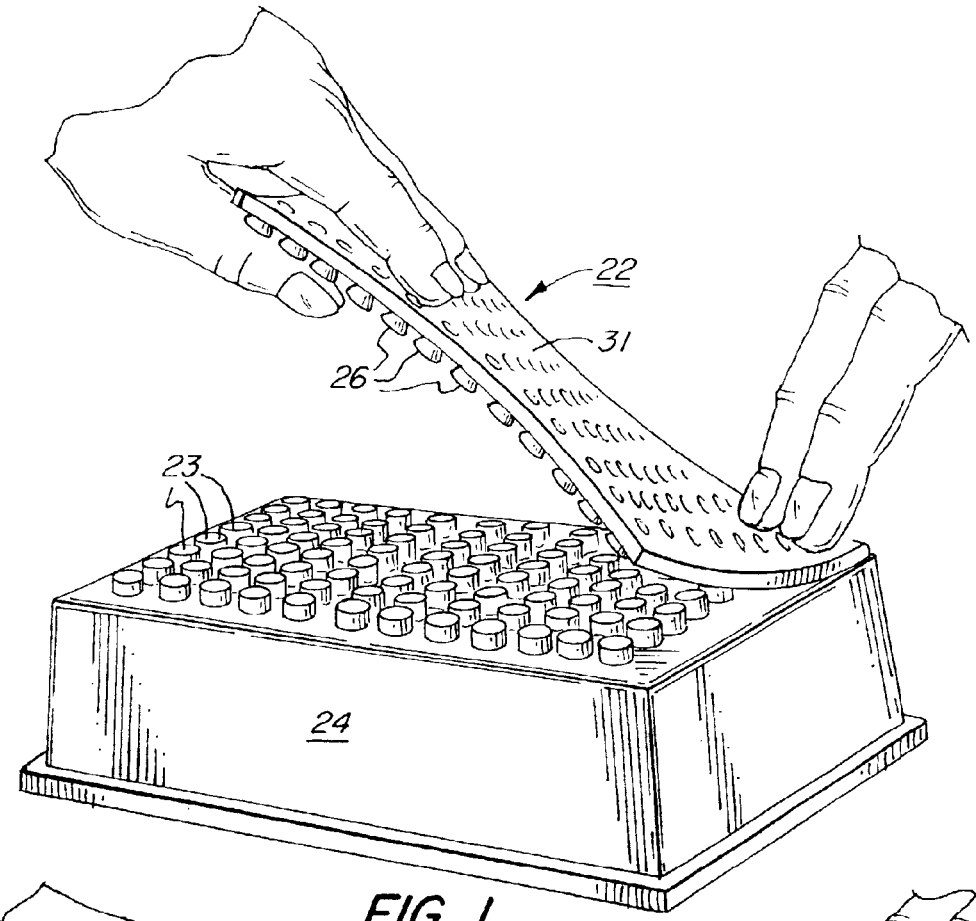
FIG. 1 is a schematic perspective view of a flexible closure plug mat of this invention at an early stage of its installation on the arrayed vials in a standard well plate.
Figure 2:
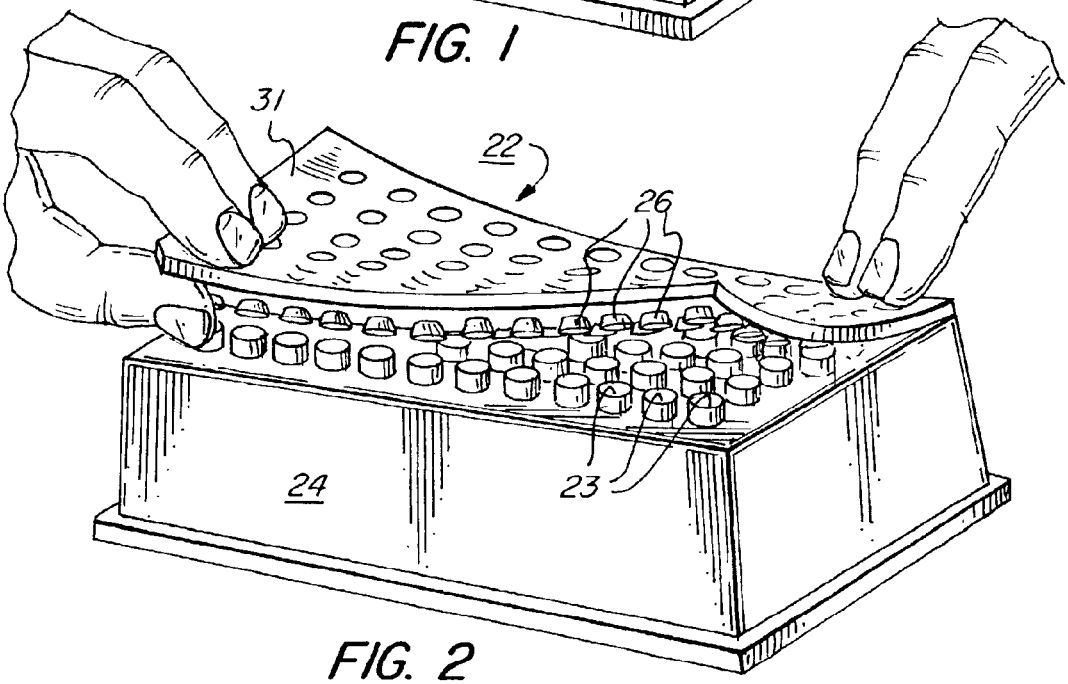
FIGS. 2 and 3 are similar perspective views showing successive later stages in the installation of the mat.
Figure 3:
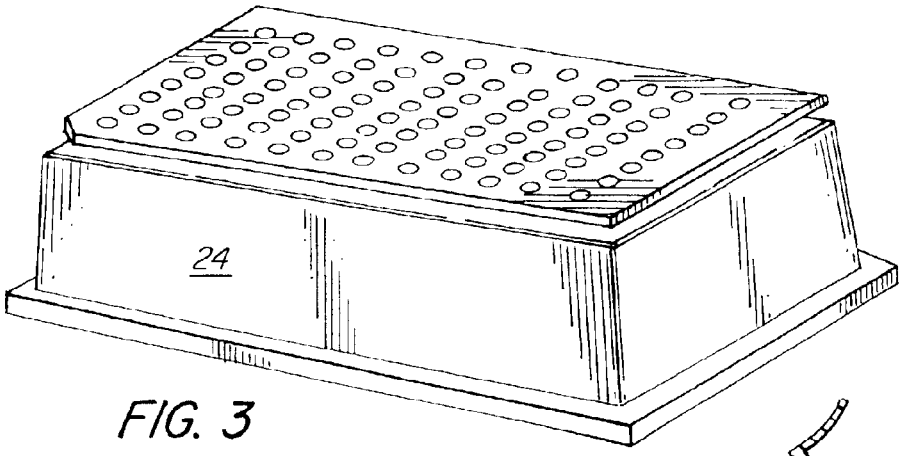
Figure 4:
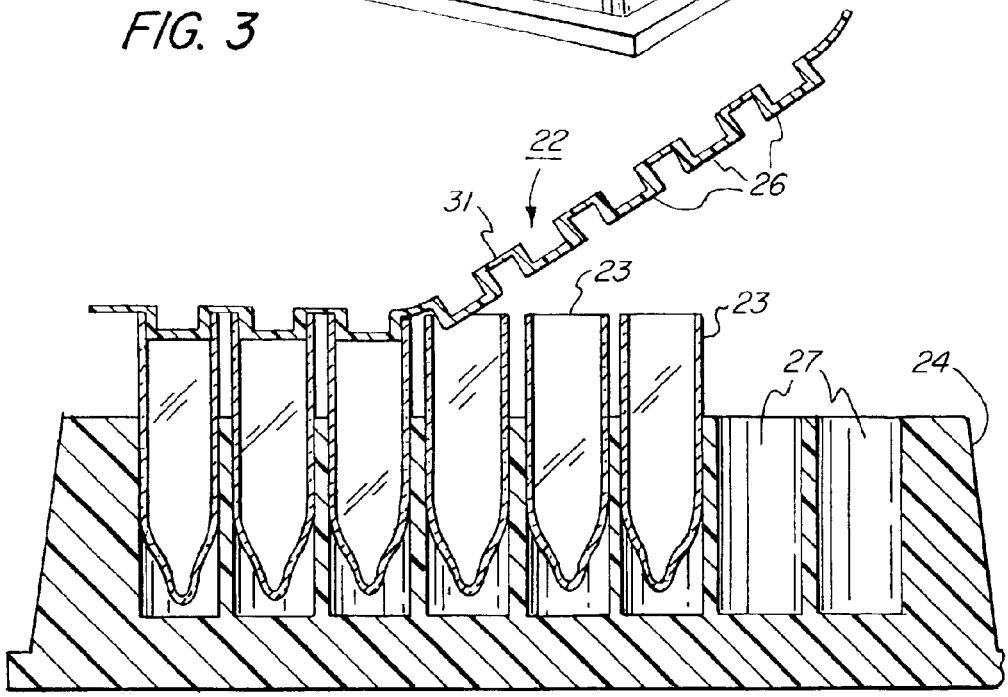
FIG. 4 is a fragmentary cross-sectional view of the well plate, the arrayed vials and the closure plug mat taken along plane 4—4 in FIG. 9 at an early stage in its installation.

Since the silicone mat body 31, the silicone body of plugs 26 and 26A and the thick Teflon® layer 21 are all flexible elastomer, the plugs 26 or 26A can be readily deformed resiliently, as they are inserted into the open tops of vials 23 or 23A, in the successively lowered stages shown schematically in FIGS. 1, 2 and 3. Their resilient traction force against the internal walls of the glass vials 23 or 23A holds them firmly in position until the plug mat 22 is peeled upward from one corner, reversing the successive installation stages through FIGS. 3, 2 and 1.

An option preferred by some users of chromatography equipment are cross-shaped or X-shaped central openings 33 in the plug floors 29 for admitting the pointed ends of pipettes into the interiors of the glass vials 23 or 23A after the plugs 26 or 26A have closed the glass vials 23 or 23A. Openings 33 are formed by slitting dies, and are normally closed by the resilience of the elastomer floors 29, avoiding contamination of the interiors of vials 23 or 23A until they are forced open by insertion of pipette tips through openings 33. Withdrawal of the pipette tips allows the resilient elastomer floors 29 to re-seal openings 33, thus avoiding contamination of the vials' contents.

It will thus be seen that the objects set forth above, and those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A flexible elastomer closure plug mat for standard arrays of open topped sample vials held in a standard array of rows and columns of a first plurality of wells formed in a standard well plate for use in autosampling chromatography equipment, comprising a flexible elastomer sheet having a top face and a bottom face, a corresponding second plurality of septa closure plugs depending from said bottom face, shaped as hollow convex cylindrical protuberances each provided with a reversely tapered sidewall having its smallest outside diameter at its proximal upper end and having its largest outside diameter at its distal lower end, and a floor having a lower outer surface and spanning and integrally joined to the distal end of each sidewall, the upper proximal end of each sidewall being integrally joined to said flexible elastomer sheet, and a unitary layer of elastomer inert to fluids and substances contained in fluids in said sample vials with a thickness between about 0.003 inches and about 0.007 inches durably and integrally bonded to the bottom face of said sheet, and to the outer surface of each protuberance floor and sidewall, forming a substantially uniform continuous layer of inert elastomer on the exposed underside surfaces of said elastomer sheet and of all said depending protuberances' floors and sidewalls overlying said open topped vials during use, whereby said flexible mat can be flexed to present one closure plug for insertion in a corresponding open topped vial, and progressively unflexed to bring successive neighboring closure plugs into alignment for insertion in their corresponding vials until all vials in the array have received closure plugs inserted therein and retained by resilient traction in said vials, while assuring that said continuous layer of inert elastomer protects the open topped vials' interiors and contents from contamination.

2. The flexible elastomer closure plug mat defined in claim 1, wherein the layer of inert elastomer is formed of polytetrafluoroethylene.

3. The flexible elastomer closure plug mat defined in claim 1, wherein the portion thereof to which the layer of inert elastomer is bonded is formed of silicone rubber.

4. The flexible elastomer closure plug mat defined in claim 1, wherein the layer of inert elastomer has a thickness between about 0.004 inches and about 0.006 inches.

5. The flexible elastomer closure plug mat defined in claim 1, wherein the flexible elastomer sheet has a thickness between about 0.012 inches and about 0.018 inches.

6. The flexible elastomer closure plug mat defined in claim 1, wherein the flexible elastomer sheet and the inert elastomer layer integrally bonded to the exposed underside surfaces of said sheet and said protuberances have a combined thickness between about 0.015 inches and about 0.025 inches.

* * * * *